US011932475B2

(12) United States Patent
Canada

(10) Patent No.: US 11,932,475 B2
(45) Date of Patent: Mar. 19, 2024

(54) PORTABLE FOOD DISPENSER FOR MANUAL-DEXTERITY CHALLENGED

(71) Applicant: Lawrence Canada, Chicago, IL (US)

(72) Inventor: Lawrence Canada, Chicago, IL (US)

(73) Assignee: The Goodie Jar, LLC, Chicago, IL (US)

( * ) Notice: Subject to any disclaimer, the term of this patent is extended or adjusted under 35 U.S.C. 154(b) by 0 days.

(21) Appl. No.: 17/934,922

(22) Filed: Sep. 23, 2022

(65) Prior Publication Data

US 2023/0122057 A1 Apr. 20, 2023

Related U.S. Application Data

(60) Provisional application No. 63/203,466, filed on Jul. 23, 2021.

(51) Int. Cl.
*B65D 83/00* (2006.01)
*B65D 25/00* (2006.01)

(52) U.S. Cl.
CPC ..... *B65D 83/0005* (2013.01); *B65D 25/005* (2013.01)

(58) Field of Classification Search
CPC ..... B65D 83/0005; B65D 83/0409; B65D 83/0022; B65D 83/0033; B65D 83/0038; B65D 25/005
USPC ..... 222/251, 344, 510, 511, 449, 284, 287, 222/365, 518, 559; 221/263, 185
See application file for complete search history.

(56) References Cited

U.S. PATENT DOCUMENTS 1,449,571 A * 3/1923 Younger ..... A47G 19/34 222/510
2,553,509 A * 5/1951 Altorfer, Jr. ..... B60H 1/246 222/361
3,159,317 A * 12/1964 Mini ..... B05B 11/107 222/409
4,555,035 A 11/1985 Davis
4,787,526 A 11/1988 Pehr
5,108,006 A * 4/1992 Tieke ..... B65D 83/0409 221/152
5,641,096 A * 6/1997 Robbins ..... A47G 19/34 222/365
6,540,115 B1 * 4/2003 Sago ..... B05B 11/1095 222/321.6
7,073,685 B1 * 7/2006 Giraud ..... B65D 83/0409 221/64

(Continued)

OTHER PUBLICATIONS

International Search Report and Written Opinion; PCT/US2023/033613; dated Oct. 25, 2023.

*Primary Examiner* — Lien M Ngo
(74) *Attorney, Agent, or Firm* — Dunlap Bennett & Ludwig, PLLC; Anna L. Kinney

(57) ABSTRACT

A food dispenser for use by manual-dexterity challenged people is disclosed. The dispenser comprises a hollow cylindrical base, a container for containing a plurality of select food items, a cylindrical cap disposed through a hollow cylindrical collar mounted atop the container and joined thereto by interfitting surface portions. The dispenser includes a piston and a compression spring disposed in an interior region of the base and abutting a portion of the base and the piston for biasing the piston and base apart and for maintaining a predetermined spacing therebetween.

9 Claims, 4 Drawing Sheets

(56) References Cited

U.S. PATENT DOCUMENTS

| | | | | |
|---|---|---|---|---|
| 2003/0234260 | A1* | 12/2003 | Giraud | B65D 83/0409 221/263 |
| 2004/0031819 | A1* | 2/2004 | Smiley | G01F 11/18 222/449 |
| 2006/0086761 | A1* | 4/2006 | Yang | G01F 11/18 222/344 |
| 2012/0267401 | A1* | 10/2012 | Schroedter | G01F 11/24 222/368 |
| 2016/0129463 | A1* | 5/2016 | Maslana | A47G 19/18 222/341 |

* cited by examiner

PORTABLE FOOD DISPENSER FOR MANUAL-DEXTERITY CHALLENGED

CROSS-REFERENCE TO RELATED APPLICATION

This nonprovisional patent application is based upon provisional U.S. Ser. No. 63/203,466, filed Jul. 23, 2021, hereby incorporated by reference in its entirety.

FIELD

The present subject matter, generally directed to a portable dispenser for manual-dexterity challenged people, is more particularly directed to a portable food container and dispenser with features enabling manual-dexterity challenged people to select food items and operate the container to dispense the food items selected.

BACKGROUND OF THE INVENTION

Repetitive opening and closing of food item containers, starting with removal of a cap or a cover from a container, followed by removal of one or more food items from the container, and concluding with using the cap or cover to close the container, can be tedious and troublesome, especially for the elderly and pediatric populations.

While containers with easy-to-open features for persons with limited manual dexterity are known (see U.S. Pat. No. 4,555,035 to Davis and U.S. Pat. No. 4,787,526 to Pehr), portable food containers having features that enable persons with limited manual dexterity to select food items contained and that dispense the selected food items are not. Currently available food dispenser devices require a user to repeatedly open containers to remove the contents, which reduces accessibility for individuals with arthritis or lack of strength to repeatedly open a container. If users don't have the knowledge or fine motor skills to open such containers, then help must be obtained.

Thus, it is clear that there is a need for a product that enables a person with fine motor skill issues or decreased strength to easily dispense food items contained.

The present subject matter, directed to a portable article for dispensing food, includes such features as a dispenser designed to operate by applying force to an upper portion of the dispenser, and using gravity to dispense food items contained.

SUMMARY OF THE INVENTION

One aspect or feature of the present subject matter is directed to scalability. In other words, a food container and dispenser embodying these principles could be sized and configured to be portable, as shown in the accompanying figures, or could be sized and configured to be fixed to a communal table and/or a grocery store shelf.

Ease of disassembly of the container/dispenser is another aspect or feature of the present subject matter. For instance, if a certain compression spring requires excessive force to be imposed upon a food-dispensing component, another spring having suitable physical properties, can be substituted, enabling manual-dexterity challenged people to exert minimal effort to dispense food items whenever desired.

These and other aspects and features of the present subject matter will be better understood after reference to the following drawings, description, and claims.

BRIEF DESCRIPTION OF THE DRAWINGS

Throughout the figures and detailed description, similar reference numerals shall be used to refer to similar components of the presently illustrated embodiment.

DETAILED DESCRIPTION OF THE INVENTION

Figure 1:
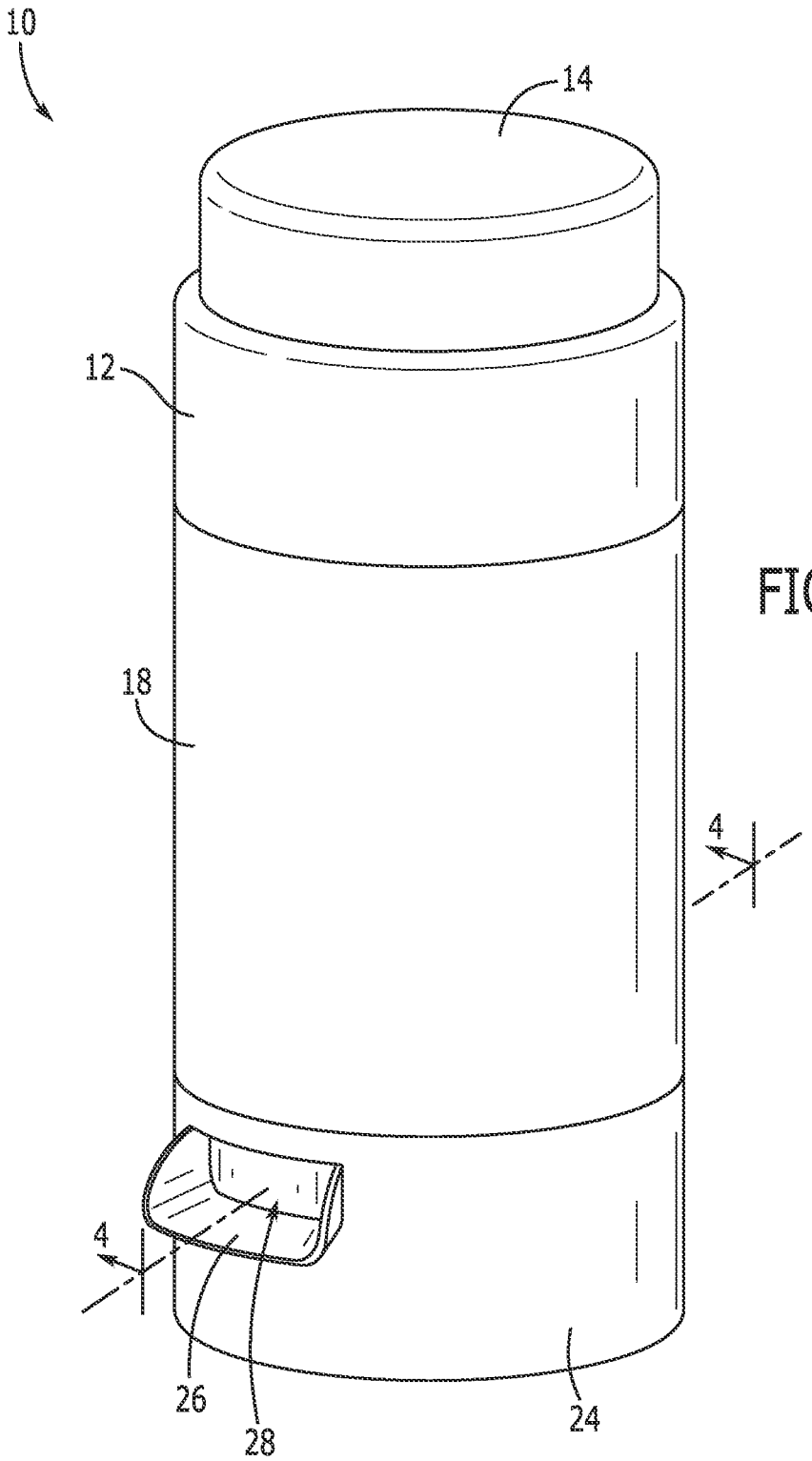
FIG. 1 is a side elevational perspective view illustrating features of the current embodiment of the present subject matter, for dispensing contained food items.

The following written description describes the best currently contemplated modes of the present subject matter including preferred structural components and operation of the illustrated embodiment. The following description is therefore not to be taken in a limiting sense but rather for purposes of presenting general principles of the present subject matter, with its scope being defined by the appended claims. Referring initially to FIGS. 1, 2, 4 and 5, a food container and dispenser 10 especially designed for use by people experiencing manual-dexterity issues includes a base 24 (preferably cylindrical when viewed looking down toward the dispenser from a horizontal plane disposed perpendicular to cross-sectional views of dispenser components presented in FIGS. 4, 5), a container 18 (also preferably cylindrical), a movable "button" or cap 14 (also preferably cylindrical), a piston 20, and a spring 22.

The base 24 is hollow and has an interior region bounded by a bottom 40 and an inner surface 42. The base 24 includes an upper edge margin 44 (FIG. 4).

Figure 4:
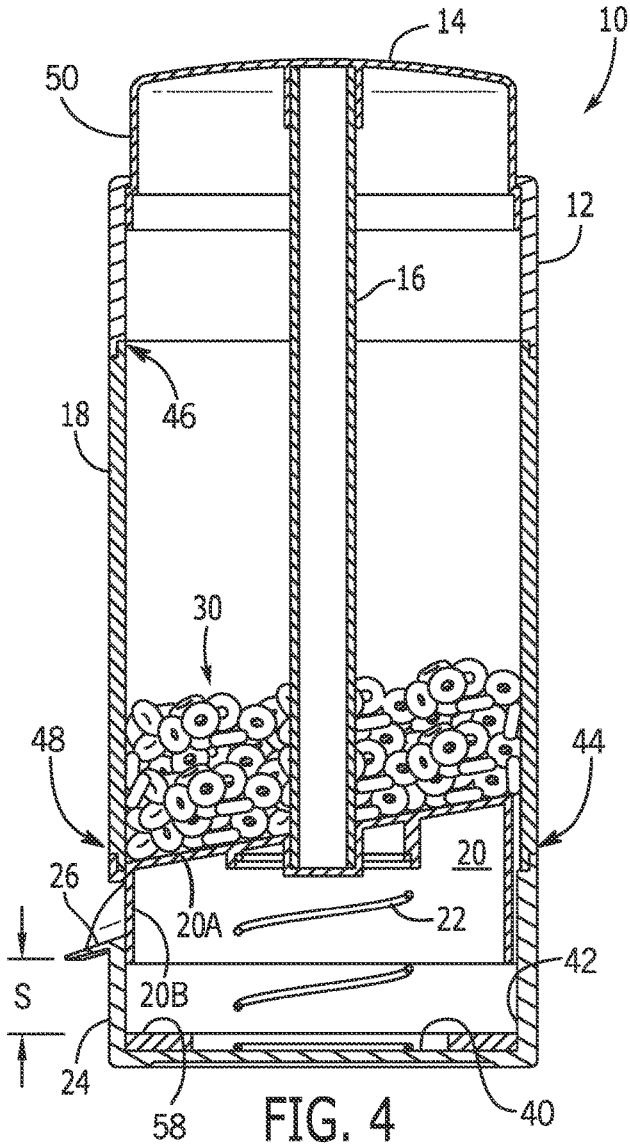
FIG. 4 is a cross-sectional view taken from the plane 4-4 shown in FIG. 1.

The container component 18 of the dispenser/container 10 of the present subject matter has upper and lower peripheral edge margins 46, 48 (FIG. 4). The upper edge margin 44 of the base 24 and the lower edge margin 48 of the container 18 are dimensioned and configured to "interfit." The term "interfit" as used throughout this patent specification shall be understood as referring to a pressed "fit" or friction "fit" manner of fastening together two tightly fitting, mating parts to result in a joint that is held together by friction after the two parts are pushed together. Such a joint is also called an "interference fit" by a person of ordinary skill in the art ("POSITA").

The "button" or cap 14 includes an outer surface 50 (FIG. 4) unitary with a peripheral edge margin 14A (FIG. 6) outwardly disposed from the outer surface 50.

Figure 6:
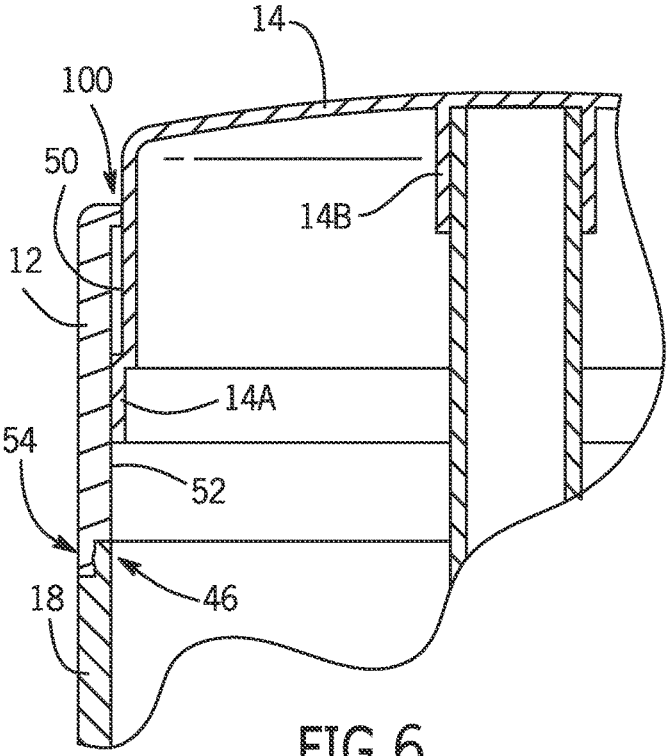
FIG. 6 is a partially fragmented view on an enlarged scale relative to FIG. 5.
Figure 5:
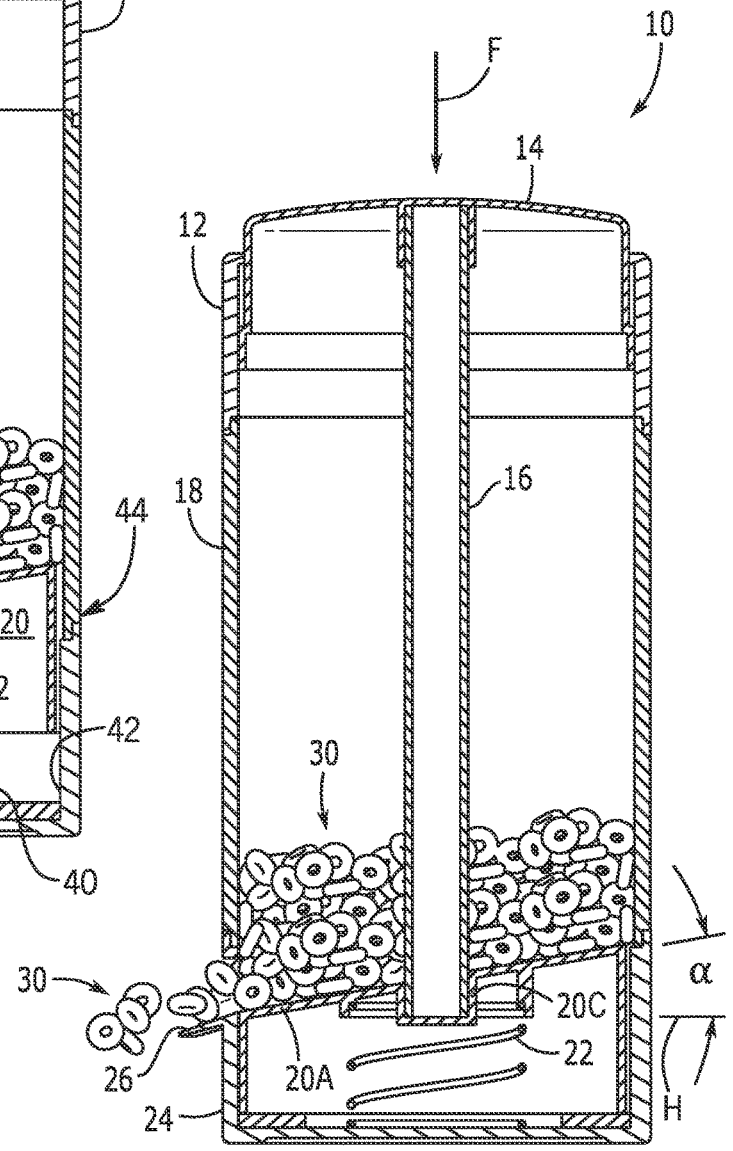
FIG. 5 is a second cross-sectional view, showing the food dispenser in use.

The collar 12 includes an inner surface 52 and a lower edge margin 54. The lower edge margin 54 of the collar 12 and the upper edge margin 46 of the container 18 are dimensioned and configured to interfit (FIG. 6). An upper surface of the cap 14 is about as wide as a human hand. In addition, the collar 12 includes an opening 56 (FIG. 2), dimensioned and configured, in relation to the cap 14, for enabling a person to exert a force ("F") on the cap 14 for dispensing food items 30 (FIG. 5). Also, the outwardly extending cap edge margin 14A (FIG. 6) is dimensioned and configured to slidingly engage the inner surface 52 of the collar 12 (FIGS. 4, 5).

The piston 20 (FIGS. 2, 4) has an upper surface 20A that is unitary with an outer peripheral edge surface (FIGS. 4, 5) which is dimensioned to slidingly engage the inner surface 42 of base 24. A sidewall of base 24 has an opening or aperture 28 (FIG. 3) through which at least a portion of the plural food items 30 (FIG. 5) in dispenser 10 can be dispensed. The piston upper surface 20A is oriented at a preselected angle ("a") relative to a horizontal surface ("H") to enable at least a portion of the plural food items 30 in container 18 to "flow" (i.e., be caused to move) through the aperture or opening 28 (FIG. 2), as a result of gravitational force.

The spring 22, preferably a compression spring, is disposed in the interior region of the base 24 between the bottom 40 of the base 24 and the piston 20 for biasing the piston 20 away from the base 24 and for maintaining a predetermined spacing ("S") therebetween (FIG. 4). Because the container/dispenser 10 is easily disassembled, if excessive force ("F") is required to depress the "button" or cap 14 (FIG. 5), another spring having physical properties (e.g., a spring constant value) for enabling less force applied to cap 14 to dispense food items 30, can be substituted. The rate or (spring constant) of a spring is the change in the force it exerts, divided by the change in deflection of the spring. Briefly, it is the gradient of the force versus a deflection curve. A spring constant for a compression spring is expressed in units of force divided by distance, e.g., newtons/meter (N/m) or pounds (force)/inch (lbf/in).

The collar 12 includes a sidewall edge margin 100 (FIG. 6) radially inwardly disposed and dimensioned to slidingly engage the outer surface 50 of the cap 14 and to abut the cap outer edge margin 14A. A spacer 58 of preselected thickness and configuration is put on the bottom 40 of the base 24, to provide the spacing ("S") when the sidewall edge margin 100 of collar 12 abuts the outer edge 14A of cap 14.

The food dispenser 10 of the present subject matter includes a rod 16, preferably hollow, disposed between the cap 14 and the base 24 for enabling a user exerting a downwardly-oriented force ("F") upon the upper surface of the cap 14 (FIG. 5) to move the upper surface 20A of the piston 20 between a first position where a sidewall 20B (FIG. 4) of the piston 20 closes the aperture 28 and a second position (FIG. 5) to enable at least a portion of the plural food items 30 in the container 18 (component of the dispenser 10) to be dispensed through the aperture 28, thereby compressing the spring 22. When the force ("F") exerted upon the cap 14 is removed, the spring 22 biases the upper surface 20A back to the first position.

The rod 16 includes opposite end portions; and the cap 14 includes an interior region within which is formed a socket 14B (FIG. 6) unitary with cap 14 and into which one end portion of rod 16 is disposed, preferably configured to provide an interference-fitted coupling. The upper surface 20A (FIG. 4) of the piston 20 defines a recess 20C (FIG. 5) unitary therewith into which the other end portion of the rod 16 is disposed, also preferably configured to provide an interference-fitted coupling.

Figure 2:
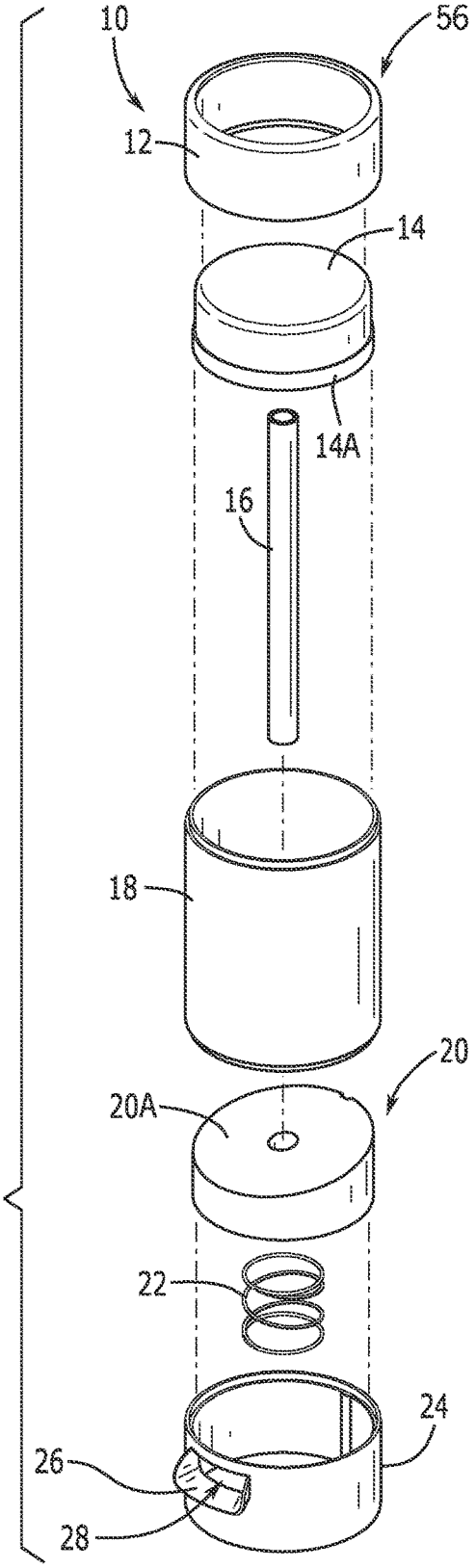
FIG. 2 is an exploded perspective view showing components of the dispenser.
Figure 3:
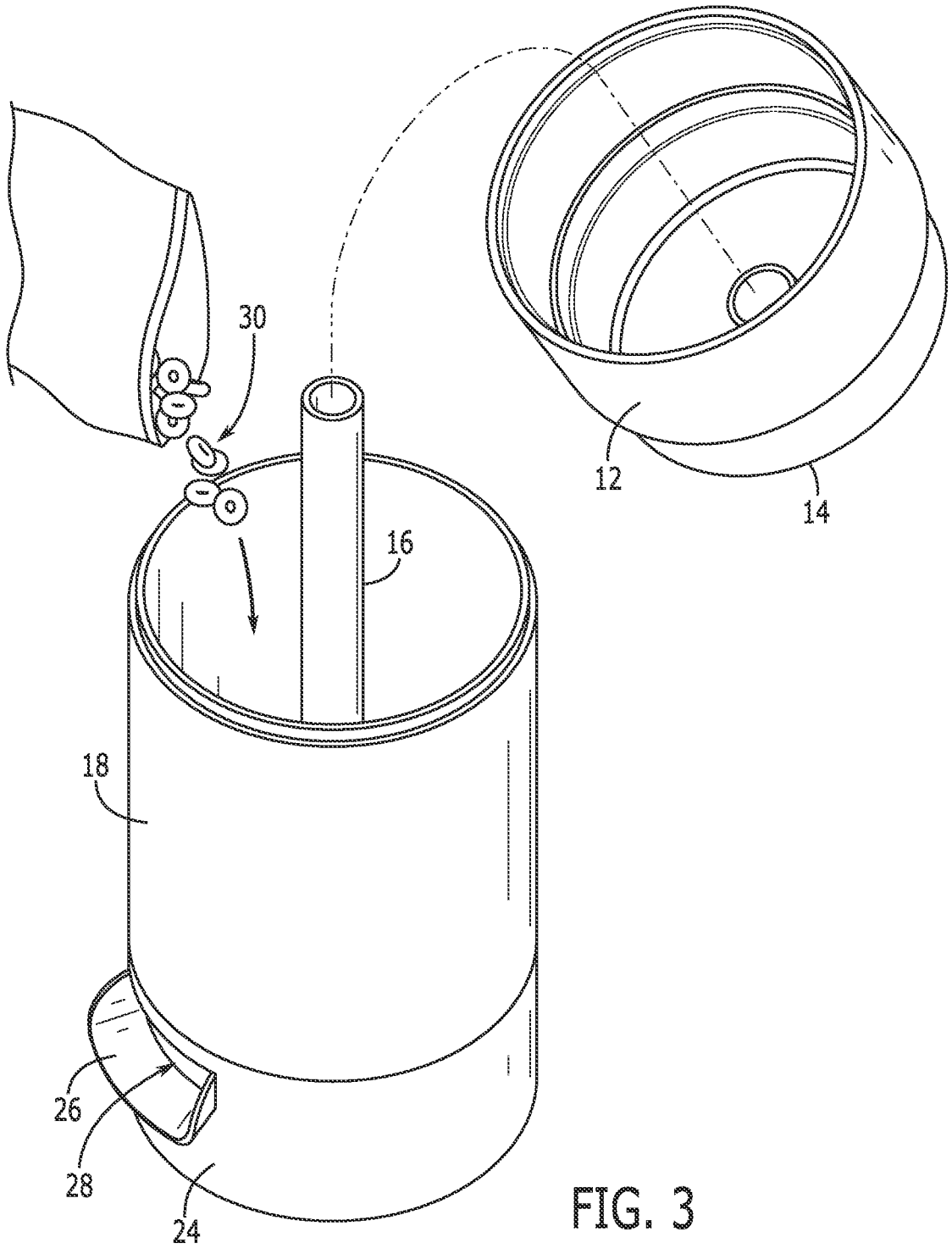
FIG. 3 is a partially disassembled view of the food dispenser shown in FIG. 1.

As noted above, the piston upper surface 20A is oriented at a preselected angle ("a") relative to a horizontal surface ("H") for enabling at least a portion of the plural food items 30 in the container 18 (component of the dispenser 10) to be moved by gravitational force through the aperture 28 when the upper surface 20A of the piston 20 is approximately at the second position (FIG. 4). An exterior surface of the base 24 defines an outwardly disposed lip 26 (FIGS. 3, 4) along a lower edge margin of aperture 28 (FIG. 2). An upper surface of the lip 26 is oriented at the same angle ("a") relative to the horizontal surface ("H"). As a result, the upper surface 20A of the piston 20 and the upper surface of the lip 26 are co-aligned. This co-aligned surface arrangement enables at least a portion of the plural food items in the container to slide along these inclined surfaces by gravitational force and thereafter pass through the aperture 28 when the piston upper surface 20A is at the second position (FIG. 5).

The food dispenser 10 of the present subject may be disassembled, filled with food items 30 (FIG. 3), and thereafter re-assembled. The collar 12 surrounding the cap 14 can be removed to fill the container 18 with a desired amount of food items dimensioned and configured to be dispensable. Thereafter, to re-assemble the food dispenser 10, after re-inserting the lower end portion of the rod 16 into the recess 20C of the piston 20 and the upper end portion of the rod 16 into the socket 14B of the cap 14, the collar 12 may next be re-joined to the container 18 to provide the above-described interference-fitted coupling therebetween when the lower edge margin 54 of the collar 12 and the upper edge margin 46 of the container 18 abut.

Downward force ("F") or pressure applied to the "button" or cap 14 enables the small pieces 30 to slide along the upper surface 20A of the piston 20 and the lip 26, and be dispensed through the opening or aperture 28 in the base 24. After use, the piston 20, rod 16, container 18, collar 12, and cap 14 may all be separated for cleaning. After being cleaned, these components can be re-attached as described.

Components of the dispenser 10 can be made by conventional manufacturing procedures which include, but are not limited to, injection-molding and/or 3D-printing processes. Components thus made can then be assembled to produce dispensers.

The components—e.g., the cap 14, collar 12, container 18, and piston 20—of the dispenser 10 of the present subject matter can be any suitable shape including but not limited to square, rectangular, pentagonal, hexagonal, and octagonal, when looking down toward the dispenser from a horizonal plane disposed perpendicular to the cross-sectional views of the dispenser components presented in FIGS. 4, 5. The aperture 28 is sized to permit unobstructed flow of food items 30. The lip 26 can be configured to fit slidably, smoothly, and snugly in dispenser 10 when not in use.

In other embodiments of the present subject matter assorted combinations of the components—e.g., the cap, the collar, the container, and/or the piston—of the dispenser can be attached together by suitable locking and/or screw mechanisms.

What has been illustrated and described in this patent specification is a food dispenser for use by people experiencing manual-dexterity issues. While the present subject matter has been described in reference to an illustrated embodiment, the present subject matter is not limited to only this embodiment. On the contrary, many alternatives, changes, and/or modifications will become apparent to those of ordinary skill in the field of the present subject matter after this patent specification has been reviewed in combination with the accompanying figures. Thus, all such alternatives, changes, and/or modifications are to be viewed as forming a part of the present subject matter insofar as they fall within the spirit and scope of the appended claims

What is claimed is:

1. A food dispenser (10) for manual-dexterity challenged people, comprising;

a hollow cylindrical base (24) defining an interior region bounded by a bottom and an inner surface, wherein the base (24) further defines an upper edge margin;

a cylindrical container (18) having upper and lower peripheral edge margins, wherein the upper edge margin of the base (24) and the lower peripheral edge margin of the container (18) are dimensioned and configured to interfit;

a cylindrical cap (14) defining an outer cylindrical surface unitary with an outer peripheral edge margin (14A) radially outwardly disposed from the cap outer surface;

a cylindrical collar (12) defining an inner surface unitary with a lower edge margin, wherein the collar lower edge margin and the container upper edge margin are dimensioned and configured to interfit, and wherein the inner surface of the collar (12) is dimensioned to slidingly engage the peripheral edge margin (14A);

a piston (20) defining an upper surface (20A) unitary with an outer peripheral edge surface dimensioned to slidingly engage the inner surface of the base (24); and a compression spring (22) disposed in the interior region of the base (24) between the bottom of the base (24) and the piston (20) for biasing the piston (20) away from the base (24) and for maintaining a predetermined spacing therebetween.

2. The food dispenser of claim 1, wherein the container (18) contains a plurality of food items, wherein a sidewall of the base (24) defines an aperture (28) through which at least a portion of the plural food items in the container can be dispensed.

3. The food dispenser (10) of claim 1, wherein the collar (12) further defines a sidewall edge margin (100) radially inwardly disposed and dimensioned to slidingly engage the outer surface of the cap (14) and abut the cap outer edge margin (14A).

4. The food dispenser of claim 2, including a rod (16) disposed between the cap (14) and the base (24) for moving the upper surface (20A) of the piston (20) between a first position where a sidewall (20B) of the piston (20) closes the aperture (28) and a second position to enable at least a portion of the plural food items in the container (18) to be dispensed through the aperture (28), thereby compressing the spring (22), whereupon the spring (22) biases the upper surface (20A) back to the first position.

5. The food dispenser (10) of claim 4, wherein the rod (16) is hollow.

6. The food dispenser of claim 4, wherein the rod (16) includes opposite end portions, wherein the cap (14) defines an interior region within which is formed a socket (14B) unitary with the cap (14) and into which one end portion of the rod (16) is disposed, and wherein the upper surface (20A) of the piston (20) defines a recess (20C) unitary therewith into which the other end portion of the rod (16) is disposed.

7. The food dispenser of (10) claim 4, wherein the piston upper surface (20A) is oriented at a preselected angle (a) relative to a horizontal surface (H) to enable at least a portion of the plural food items in the container to be moved by gravitational force through the aperture (28) when the upper surface is at the second position.

8. The food dispenser of claim 4, wherein an exterior surface of the base (24) defines an outwardly disposed lip (26) along a lower edge margin of the aperture.

9. The food dispenser of claim 7, wherein an exterior surface of the base (24) defines an outwardly disposed lip (26) along a lower edge margin of the aperture (28), wherein an upper surface of the lip (26) is oriented at a preselected angle (a) relative to a horizontal surface (H), and wherein the upper surface of piston upper surface (20A) and the upper surface of the lip (26) are co-aligned for enabling at least a portion of the plural food items in the container to be moved by gravitational force through the aperture when the piston upper surface is at the second position.

* * * * *